US005308408A

United States Patent [19]

Katila

[11] Patent Number: 5,308,408

[45] Date of Patent: May 3, 1994

[54] AUSTENITIC WEAR RESISTANT STEEL AND METHOD FOR HEAT TREATMENT THEREOF

[75] Inventor: Reijo Katila, Tampere, Finland

[73] Assignee: Lokomo Oy, Tampere, Finland

[21] Appl. No.: 984,590

[22] PCT Filed: Sep. 12, 1991

[86] PCT No.: PCT/FI91/00279

§ 371 Date: Mar. 9, 1993

§ 102(e) Date: Mar. 9, 1993

[87] PCT Pub. No.: WO92/04478

PCT Pub. Date: Mar. 19, 1992

[30] Foreign Application Priority Data

Sep. 12, 1990 [FI] Finland ..... 904500

[51] Int. Cl.[5] ..... C22C 38/04; C21D 6/02

[52] U.S. Cl. ..... 148/328; 148/329; 148/619

[58] Field of Search ..... 420/74, 75, 72; 148/328, 329, 619

[56] References Cited

U.S. PATENT DOCUMENTS 4,394,168 7/1983 Hartvig et al. .

FOREIGN PATENT DOCUMENTS 0143873 6/1985 European Pat. Off. .
0174418 3/1986 European Pat. Off. .
71352 9/1986 Finland .
50-10247 4/1975 Japan ..... 420/74
163289 1/1990 Norway .
422597 3/1982 Sweden .
WO84/01175 3/1984 World Int. Prop. O. .

*Primary Examiner*—Deborah Yee
*Attorney, Agent, or Firm*—Burns, Doane, Swecker & Mathis

[57] ABSTRACT

A wear resisting steel of the Hadfield-type and method for its production are provided. This iron base alloy contains in its basic composition following alloying carbon, manganese, silicon and optionally chromium, and/or molybdenum, and/or tungsten. The matrix of the steel is formed by the ductile austenite. Carbides appear on the grain boundaries in the form of roundish, hard, separate precipitates. In the grain boundary zone and inside the grains are hard, needle-shaped nitride and carbonitrides to improve the wear resistance especially against abrasive wear. In accordance with the method the steel is solution heat treated at a temperature range below 1100° C. (e.g., 950° to below 1100° C.) so that carbide, nitride and carbonitride precipitates formed in the microstructure following casting are partially but not completely dissolved.

6 Claims, 1 Drawing Sheet

AUSTENITIC WEAR RESISTANT STEEL AND METHOD FOR HEAT TREATMENT THEREOF

This invention concerns a high alloyed wear resisting manganese steel of Hadfield-type and its production method.

Hadfield steels have been known since the 1880's. They are used mainly as cast products e.g. as wear parts of stone crushers, excavator buckets and loader shovels. In these operating conditions the steel pieces are exposed to very strong impact and abrasive wear and to heavy impact stresses.

Hadfield steels are suitable for the types of wear conditions described above, because after the heat treatment their microstructure is austenitic and thus very ductile. In this condition the hardness is relatively low—approx. 200 . . . 250 BHN—and the wear resistance is not very good. The most important feature of the Hadfield steels is the strong work hardening ability as a result of impacts and pressure against the steel surface. The surface hardness of the steel can in such a case increase up to 550 BHN. This hardening is limited, however, into a thin surface layer of the steel whereas the inner part remains soft and ductile and the whole steel shows a ductile behaviour. The prerequisite for this kind of behaviour is that the microstructure of the steel is fully austenitic without continuous band of carbides at the grain boundaries. In the as cast condition all the grain boundaries in the microstructure are filled with brittle mixed carbides—mainly iron/manganese carbides and the whole behaviour of the steel is brittle. Under impacts and other mechanical stresses the steel breaks along the brittle grain boundaries. The grain boundary carbides can be eliminated by a solution heat treatment at temperatures of over 1000° C. and by an immediate rapid cooling after the soaking, by a quenching. During the high temperature soaking the grain boundary carbides dissolve into the steel matrix and the rapid quenching prevents the reprecipitation of the carbides.

A fully austenitic, carbide-free, ductile Hadfield steel serves very well in the wear parts of traditional jaw and cone crushers and also in the front plates of buckets in quarry conditions under heavy impact loads. The crushers described above break the stones by impact and compression and also in the quarry loading the impact stresses are heavy. The crushing efficiency of the modern jaw and cone crushers has been raised by increasing the stroke length and by transforming the crushing by compression alone into a combined effect of compression and shear. In these types of crushing processes the formerly impact load has largely been replaced by an abrasive wear with a result that the impact loads against the wear parts have not been strong enough to cause the maximum work hardening of the Hadfield steel and the relative service life of the wear parts has shortened. The situation is the same in the excavator buckets and loader shovels when loading fine grain material, where the impact and compression loads are not always sufficient for the work hardening of Hadfield steels. The wear resistance of this kind of non-work hardened steel without any hard components in the microstructure has not proved to be sufficient in the operating conditions of the modern crushers nor in the loading of fine grain material.

Attempts have been made to improve the work hardening ability of the Hadfield steel whose original chemical composition is:

| | |
|---|---|
| Carbon | 1.0 . . . 1.4% |
| Manganese | 10.0 . . . 15.0% |
| Silicon | 0.3 . . . 1.5% |
| Phosphorus | max 0,07% |
| Sulphur | max 0.07% |

by using additional alloying. The elements favouring ferrite—chromium, molybdenum, vanadium and tungsten—have proved to have the best effect on the work hardening ability. These alloying elements are also very strong carbide formers and in addition to the improvement of work hardening ability the carbide network at the grain boundaries is stabilized and thickened—it is difficult to eliminate it by the heat treatment. These grain boundary carbides improve the wear resistance of the steel in abrasive wear—it is true, but as fully brittle components in the microstructure they cause the break down of the whole steel part under impact loads. Alloying elements favouring austenite—mainly nickel and copper—have no essential effect on the work hardening nor on the carbide formation. By increasing the manganese content to a range of 15 to 21% it is possible to increase the wear resistance to some extent due to an improvement in the work hardening ability, but no hard particles needed against abrasive wear can be produced in the microstructure by using this method.

The requirements for steels to be used as wear parts of the modern crushers are:

intensive and easy work hardening, hard, discontinuously distributed particles in the microstructure to improve the resistance against abrasive wear, sufficient ductility to withstand the impact and compression loads against the wear part.

The characteristics of the invention steel are presented hereafter. A number of advantageous performance forms additionally are described hereafter.

The work hardening tendency in the new wear resisting invention steel of Hadfield-type has been strengthened also by using nitrogen as alloying element and separately distributed hard particles have been introduced into the microstructure by alloying with nitrogen and also with strong nitride formers—chromium, molybdenum, vanadium, tungsten, titanium or niobium—for reacting with nitrogen to nitrides. The chemical composition of the new wear resisting invention steel is at its best as follows:

| | |
|---|---|
| Carbon | 1.0 . . . 1.5% |
| Silicon | 0.3 . . . 1.5% |
| Manganese | 11.0 . . . 21.0% |
| Phosphorus | max 0.07% |
| Sulphur | max 0.07% |
| Chromium | 0.0 . . . 4.0% |
| Molybdenum | 0.0 . . . 3.0% |
| Tungsten | 0.0 . . . 2.0% |
| Nitrogen | 0.05 . . . 0.35% |

and in addition alternatively some of the following elements alone or as combinations:

| | |
|---|---|
| Vanadium | 0.10 . . . 0.60% |
| Titanium | 0.10 . . . 0.50% |

-continued

| | |
|---|---|
| Niobium | 0.10 . . . 0.30% |

The steel is killed with aluminium.

Nitrogen strengthens the austenitic structure as an austenite former. For instance, the yield strength (0.2%-strength) of the stainless steels of AISI 300 series can be increased up to 50% by alloying with nitrogen. An even bigger increase in the strength by using nitrogen alloying can be achieved in AISI 200 series stainless steels, in which the nickel content of the AISI 300 series steels has partially been replaced by manganese in order to maintain the austenitic structure despite of the decrease of nickel content.

On the other hand, nitrogen alloyed austenitic stainless steels work harden in cold working stronger than nitrogen-free grades and also with smaller deformation degrees. With respect to the work hardening, too, the manganese containing steels of AISI 200 series are more easily work hardenable and to a higher hardness than the steels of AISI 300 series.

The strengthening effect of nitrogen on the work hardening begins when the nitrogen content is 0.05% or more and the effect increases with increasing nitrogen content. On the other hand, higher nitrogen contents increase the risk to gas porosity of steel castings when the total gas content exceeds the solubility limit of the steel. In austenitic steels the risk is, however, clearly less significant than in ferritic steels and the solubility of nitrogen in the steel is increased especially by such elements like manganese and/or chromium, the contents of which are high in the invention steel—thus nitrogen can be alloyed up to 0.35% content without formation of blowholes.

Another effect of the nitrogen alloying in the Hadfield steel is that in combination with strong nitride forming elements it forms hard nitrides on the grain boundary zones and partially transforms the grain boundary carbides into carbonitrides. At very high temperatures these nitrides and carbonitrides are soluble in the austenitic matrix. In the normal solution heat treatment temperatures of Hadfield steels from 1050° to 1100° C. nitrides and carbonitrides are dissolved only partially and the remaining portion of these splits up into separate precipitates. Chromium/iron/manganese carbides and carbonitrides generally take the form of continuous large-sized precipitates, but if they are modified with vanadium, titanium or niobium, especially the nitrides and carbonitrides are made to separate as isolated needles in the austenitic matrix. In the steel in the as cast condition the grain boundaries with a carbide network are broadened to grain boundary zones consisting of an austenitic matrix, hard carbides as separate precipitates on the original grain boundary and separate nitride and carbonitride needles buried in the austenite matrix on the both sides of the original grain boundary.

BRIEF DESCRIPTION OF THE DRAWING

The enclosed FIG. 1 with a magnification of 500× presenting the microstructure of the invention steel in the delivery condition shows the enlarged grain boundary zone with separate carbide precipitations and with separate needles of nitrides and carbonitrides buried in the austenitic matrix.

The hardness of the wear resisting invention steel in its delivery condition (FIG. 1) is about 270 to 300 BHN and fully work hardened it reaches a hardness of about 550 BHN. Separate carbide precipitations and needle shaped nitride and carbonitride precipitations with hardnesses of 700 to 1000 HV are buried in the broad grain boundary zones of the austenitic matrix. These separate, fine distributed hard precipitates act efficiently in preventing the abrasive wear. Plastic deformation is needed for the work hardening of the austenitic matrix to its maximum hardness, but the amount of plastic deformation for the invention steel is about a half of that what is needed for the hardening of a fully austenitic steel to its maximum value.

Figure 1:
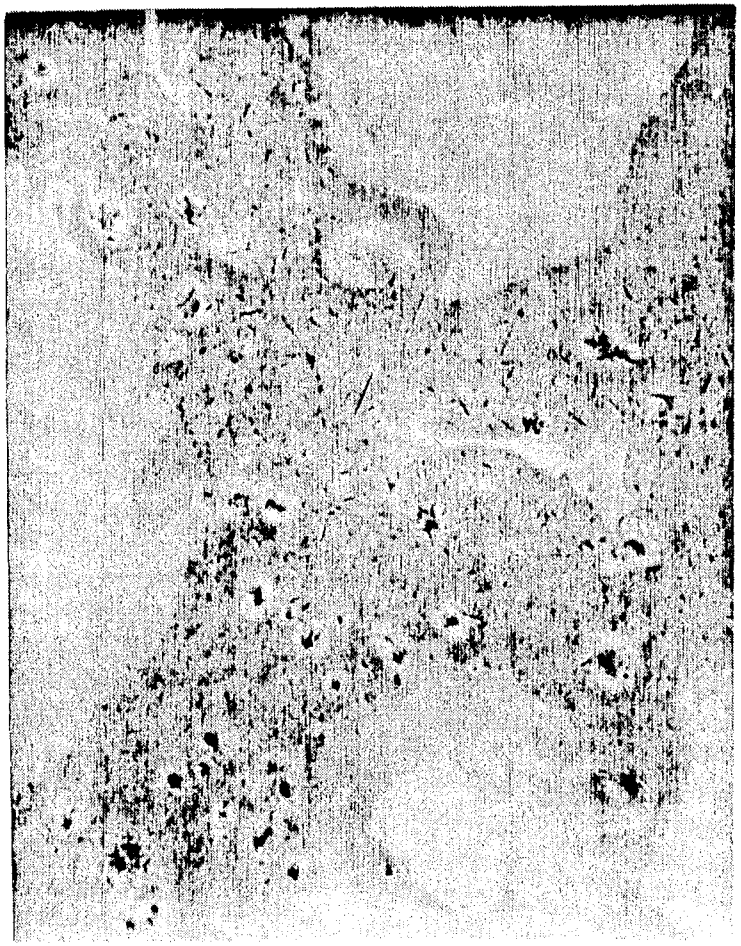

The KV impact toughness of the invention steel is about 30 to 70 J at −40° C., which seems to be sufficient for the conditions where the steel is used.

In a practical test, in which comparison was made between cones made of chromium alloyed fully austenitic traditional Hadfield steel and cones made of the invention steel as wear parts of a gyratory crusher when crushing a very abrasive material—quartzite—it was noticed that the invention steel gave 70 to 100% longer life times than the normal Hadfield steel. The operation conditions were the same.

The chemical composition of the invention steel used in the test was as follows:

| | |
|---|---|
| Carbon | 1.23% |
| Silicon | 1.23% |
| Manganese | 16.70% |
| Phosphorus | 0.046% |
| Sulphur | 0.002% |
| Chromium | 1.78% |
| Vanadium | 0.13% |
| Aluminium | 0.020% |
| Nitrogen | 0.060% |

The cast wear parts were heat treated as follows: Solution heat treatment at 1000° C. 5 hours and finally water quenching.

The test was carried out at a quartzite crushing plant, where the crushed amount of quartzite was 10000 to 20000 tonnes when the wear parts made of conventional Hadfield steel were used. When the wear parts made of the invention steel were used the crushed amount of quartzite was 32000 to 35000 tonnes.

The melting practice of this wear resisting invention steel begins in a quite normal way. The base charge is melted in an electric arc or induction furnace. The needed alloying takes place in the furnace. The last elements to be alloyed are vanadium (or titanium or niobium) and nitrogen, which are alloyed either in the furnace or in the ladle. Vanadium (or titanium or niobium) and nitrogen contents are selected within the composition range mentioned before so, that the content of these special elements are near the lower limit of the range if the steel will be used under very severe impact loads and near the upper limit when the steel is used mainly under abrasive wear.

The steel is poured into a sand or chill mould and after the solidification and cooling to the room temperature the casting is fettled in a normal way.

The final stage in the production process is the solution heat treatment, which is carried out in the temperature range of 950° to 1100° C. depending on the content of the special alloying elements in the steel. The heat treatment temperature is selected from the above mentioned range so that during the treatment the grain boundary carbides, nitrides and carbonitrides are dissolved only partially into the austenitic matrix and that their continuous network breaks into separate roundish carbide precipitations on the grain boundaries and into needle shaped nitrides and carbonitrides in the grain boundary zones and also inside the grains. Between these separate precipitates remains a ductile austenite matrix. This microstructure formed during the solution heat treatment is made to remain also at room temperature by using a rapid cooling—by a water quenching.

The wear resisting invention steel is best suitable for such applications as the wear parts of various crushers as well as of excavator buckets and loader shovels, like wear plates and teeth.

The individual composition and heat treatment process of the invention steel will be selected so that steels exposed to severe impact loads—wear parts of primary crushers and quarry loaders—have a microstructure, which contains fewer precipitates in the grain boundary zones than steels, which will be used mainly under abrasive wearing conditions—wear parts for intermediate and fine crushers and for excavators.

I claim:

1. A wear resisting steel alloyed with manganese having a ductile austenitic microstructure wherein said steel contains carbon, silicon, manganese, chromium, molybdenum and tungsten in following contents:

| | |
|---|---|
| Carbon | 1.0 to 1.5%, |
| Silicon | 0.3 to 1.5%, |
| Manganese | 11.0 to 21.0% |
| Chromium | 0.0 to 4.0%, |
| Molybdenum | 0.0 to 3.0%, and |
| Tungsten | 0.0 to 2.0%. |

and as additional alloying elements nitrogen and at least one of vanadium, titanium and niobium in following contents:

| | |
|---|---|
| Nitrogen | 0.05 to 0.35%, |
| Vanadium | 0.10 to 0.60%, |
| Titanium | 0.10 to 0.50%, and |
| Niobium | 0.10 to 0.30%, |

and the balance being iron and normal quantities of impurities, and wherein carbides are present on the grain boundaries as hard precipitates, and hard mainly needle-shaped nitrides and carbonitrides are present in the grain boundary zone and inside the grains which serve to improve wear resistance.

2. A wear resisting steel according to claim 1, wherein said carbide, nitride and carbonitride precipitates were initially formed in the microstructure during the slow cooling after casting and subsequently have been dissolved partially but not entirely upon solution heat treatment.

3. A method for producing a wear resisting steel alloyed with magnesium having a ductile austenitic microstructure, wherein said steel contains carbon, silicon, manganese, chromium, molybdenum, and tungsten in the following contents:

| | |
|---|---|
| Carbon | 1.0 to 1.5%, |
| Silicon | 0.3 to 1.5%, |
| Manganese | 11.0 to 21.0% |
| Chromium | 0.0 to 4.0%, |
| Molybdenum | 0.0 to 3.0%, and |
| Tungsten | 0.0 to 2.0%, |

and as additional alloying elements nitrogen and at least one of vanadium, titanium and niobium in the following contents:

| | |
|---|---|
| Nitrogen | 0.05 to 0.35%, |
| Vanadium | 0.10 to 0.60%, |
| Titanium | 0.10 to 0.50%, and |
| Niobium | 0.10 to 0.30%, |

and the balance being iron and normal quantities of impurities, said method consisting essentially of melting and casting said steel wherein carbide, nitride and carbonitride precipitates are formed therein, solution heating treating the cast steel at a temperature under 1100° C. and partially dissolving said carbide, nitride and carbonitride precipitates present therein, and rapidly cooling the solution heat-treated steel.

4. A method according to claim 3, wherein the solution heat treatment is carried out in the temperature range of 950° to under 1100° C.

5. A wear resisting steel according to claim 2 wherein said solution heat treatment was carried out at a temperature under 1100° C.

6. A wear resisting steel according to claim 2 wherein said solution heat treatment was carried out at a temperature in the range of 950° to under 1100° C.

* * * * *